US009959859B2

(12) United States Patent
Butts

(10) Patent No.: US 9,959,859 B2
(45) Date of Patent: May 1, 2018

(54) ACTIVE NOISE-CONTROL SYSTEM WITH SOURCE-SEPARATED REFERENCE SIGNAL

(71) Applicant: Harman International Industries, Inc., Stamford, CT (US)

(72) Inventor: Donald Joseph Butts, Westport, CT (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days. days.

(21) Appl. No.: 14/986,527

(22) Filed: Dec. 31, 2015

(65) Prior Publication Data

US 2017/0193975 A1 Jul. 6, 2017

(51) Int. Cl.

| | |
|---|---|
| ***G10K 11/178*** | (2006.01) |
| ***G10L 21/0216*** | (2013.01) |
| ***F01N 1/06*** | (2006.01) |

(52) U.S. Cl.

CPC ..... *G10K 11/178* (2013.01); *F01N 1/065* (2013.01); *G10L 21/0216* (2013.01); *F01N 2560/14* (2013.01); *G10K 11/1784* (2013.01); *G10K 2210/3012* (2013.01); *G10K 2210/3027* (2013.01); *G10K 2210/3028* (2013.01)

(58) Field of Classification Search

CPC ..... G10K 11/178–11/1788; G10K 2210/00–2210/512; H04R 2460/01

See application file for complete search history.

(56) References Cited

U.S. PATENT DOCUMENTS

| | | | | |
|---|---|---|---|---|
| 5,267,320 | A * | 11/1993 | Fukumizu | G10K 11/1784 381/71.12 |
| 5,548,652 | A * | 8/1996 | Fujiwara | G10K 11/1788 381/71.6 |
| 9,442,496 | B1 | 9/2016 | Beckman et al. | |
| 2007/0223720 | A1* | 9/2007 | Goldberg | H04R 1/1041 381/74 |
| 2008/0187148 | A1* | 8/2008 | Itabashi | G10K 11/178 381/71.6 |
| 2009/0292528 | A1 | 11/2009 | Kameyama | |
| 2012/0155667 | A1 | 6/2012 | Nair | |

(Continued)

OTHER PUBLICATIONS

Extended European Search Report for Application No. EP16207106.2 dated Apr. 21, 2017, 10 pages.

*Primary Examiner* — Mark Fischer
(74) *Attorney, Agent, or Firm* — Artegis Law Group, LLP

(57) ABSTRACT

The various embodiments set forth an active noise cancellation system that includes a source separation algorithm. The source separation algorithm enables the identification of acoustic inputs from a particular sound source based on a reference signal generated with one or more microphones. Consequently, the identified acoustic inputs can be cancelled or damped in a targeted listening location via an acoustic correction signal, where the acoustic correction signal is generated based on a sound source separated from the reference signal. Advantageously, the reference signal can be generated with a microphone, even though such a reference signal may include a combination of multiple acoustic inputs. Thus, noise sources that cannot be individually measured, for example with an accelerometer mounted to a vibrating structure, can still be identified and actively cancelled.

22 Claims, 4 Drawing Sheets

(56) References Cited

U.S. PATENT DOCUMENTS

| | | | | |
|---|---|---|---|---|
| 2013/0164135 | A1* | 6/2013 | Himmelmann ..... | G10K 11/178<br>416/146 R |
| 2015/0249886 | A1 | 9/2015 | Haylett et al. | |
| 2015/0294662 | A1 | 10/2015 | Ibrahim | |
| 2016/0125869 | A1* | 5/2016 | Kulavik ..... | G10K 11/178<br>381/71.6 |
| 2016/0162254 | A1* | 6/2016 | Benattar ..... | H04R 1/1083<br>700/94 |
| 2016/0163303 | A1* | 6/2016 | Benattar ..... | G10K 11/175<br>381/71.11 |

* cited by examiner

ACTIVE NOISE-CONTROL SYSTEM WITH SOURCE-SEPARATED REFERENCE SIGNAL

BACKGROUND

Field of the Various Embodiments

The various embodiments relate generally to active noise control and, more specifically, to an active noise-control system with source-separated reference signal.

Description of the Related Art

Active noise control (ANC) systems are oftentimes employed to suppress unwanted acoustic noise signals with noise-cancelling signals. Ideally, a noise-cancelling signal has the same amplitude and frequency components as the acoustic noise signal to be suppressed, but with a phase shift of 180° with respect to the noise signal. The noise-cancelling signal interferes destructively with the noise signal, and thus eliminates or damps the unwanted acoustic noise signal in a particular location.

ANC systems are commonly employed in motor vehicles, aircraft, and headphones, to enhance in-vehicle audio entertainment, facilitate conversation, and reduce discomfort associated with high volume ambient noise. The degree of noise reduction imparted by such systems is strongly dependent on the coherence between the correcting sound signal and the reference signal used to generate the correcting sound signal. To generate a noise-cancelling signal having high coherence with the reference signal, a given ANC system typically includes a noise sensor, such as an accelerometer or other non-acoustic sensor, directly mounted on a vibrating structure that generates unwanted noise.

However, for noise sources that are spatially uncorrelated, i.e., where the noise source is not tied to a vibrating structure, achieving adequate correlation using non-acoustic sensors is problematic, because the noise sources are not a vibrating structures on which such sensors can be mounted. For example, tire noise or the turbulent boundary layer outside a moving vehicle are not generated by the vibrations of a physical structure, and therefore cannot be directly measured with an accelerometer. Consequently, ANC systems are not very effective in reducing noise generated by noise sources such as these that are spatially uncorrelated.

Accordingly, what would be useful is an ANC system that can reduce noise generated by noise sources that are not vibrating structures.

SUMMARY

The various embodiments set forth a method for actively cancelling noise, the method comprising receiving an electronic reference signal from one or more microphones that receives a first acoustic input from a first sound source and a second acoustic input from a second sound source; based on the reference signal and on a database of recorded sound signatures, determining a separated signal that corresponds to the first acoustic input; generating a source-separated reference signal based on the separated signal; and generating an electronic correction signal based on the source-separated reference signal.

At least one advantage of the disclosed embodiments is that noise sources that cannot be individually measured, for example with an accelerometer mounted to a vibrating structure, can still be identified and actively cancelled.

BRIEF DESCRIPTION OF THE SEVERAL VIEWS OF THE DRAWINGS

So that the manner in which the above recited features of the various embodiments can be understood in detail, a more particular description of the various embodiments, briefly summarized above, may be had by reference to embodiments, some of which are illustrated in the appended drawings. It is to be noted, however, that the appended drawings illustrate only typical embodiments and are therefore not to be considered limiting of its scope, for the various embodiments may admit to other equally effective embodiments.

For clarity, identical reference numbers have been used, where applicable, to designate identical elements that are common between figures. It is contemplated that features of one embodiment may be incorporated in other embodiments without further recitation.

DETAILED DESCRIPTION

Figure 1A:
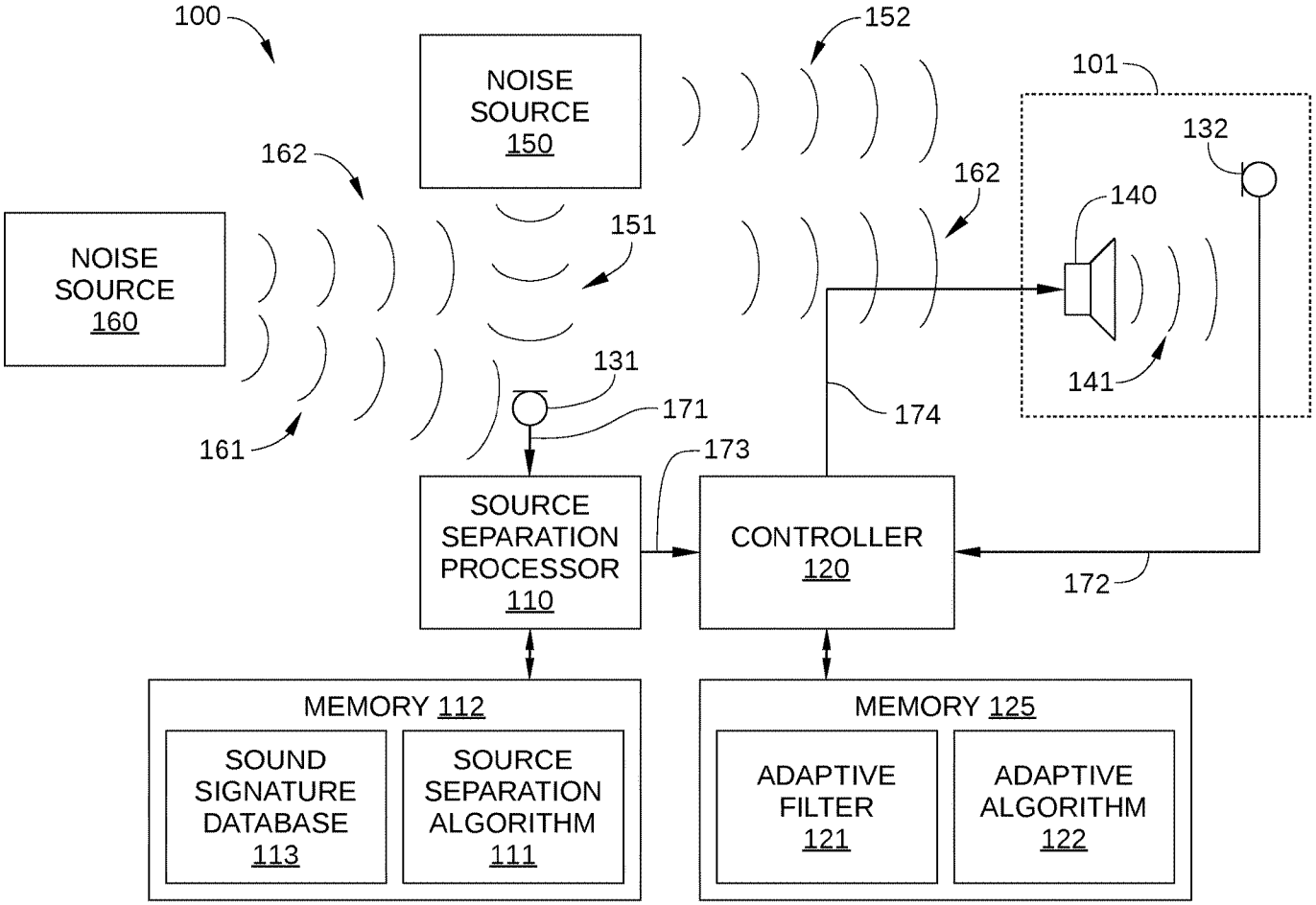
FIG. 1A is a block diagram of an active noise cancellation system, according to various embodiments.

FIG. 1 is a block diagram of an active noise cancellation (ANC) system 100, according to various embodiments. ANC system 100 may be a feed-forward active noise-cancellation system configured for use in a motor-vehicle or aircraft, or may be incorporated into any other environment, such as a room in a home, a headphone system, etc. As shown, ANC system 100 includes a source separation processor 110, a controller 120, an acoustic actuator 140, a reference microphone 131 coupled to the source separation processor 110, and an error microphone 132 coupled to the controller 120 and disposed in a listening location 101. Listening location 101 is the area targeted for maximum noise reduction by ANC system 100, such as a rear passenger area in a motor vehicle equipped with audio entertainment, or a region that includes the head of a passenger or driver.

In some embodiments, ANC system 100 may configured as a subsystem of a vehicle infotainment system associated with the vehicle and share computational resources therewith. In other embodiments, ANC system 100 may be implemented as a stand-alone or add-on feature, part of the original equipment manufacturer (OEM) controls of the vehicle, or a combination of both.

Source separation processor 110 may be any suitable processor, such as a CPU, a graphics processing unit (GPU), an application-specific integrated circuit (ASIC), a field programmable gate array (FPGA), a digital signal processor (DSP), any other type of processing device, or a combination of different processing devices. In general, source separation processor 110 may be any technically feasible hardware unit capable of processing data and/or executing source separation algorithm 111 and software applications facilitating operation of ANC system 100 as described herein. In some embodiments, source separation processor 110 is coupled to a memory 112, and source separation algorithm 111 and a sound signature database 113 reside in memory 112 during operation. Memory 112 generally includes storage chips, such as random access memory (RAM) chips, that store applications and data for processing by source separation processor 110.

Source separation algorithm 111 may be similar to a conventional artificial intelligence or machine-learning algorithm trained to identify and separate one or more sound sources from an electronic reference signal 171. Thus, source separation algorithm 111 may be configured to build a model from example inputs to make data-driven decisions, rather than following strictly static program instructions. In such embodiments, source separation algorithm 111 may be initially "trained" by simulating particular sound-generating conditions, and can then recognize sound signals that correspond to such sound-generating conditions during operation. In some embodiments, source separation algorithm 111 is configured to compare electronic reference signal 171 to a sound signature database 113 to facilitate identification of one or more sound sources in electronic reference signal 171, such as speech, air turbulence, road noise, and the like. In such embodiments, for a particular model of motor vehicle or aircraft, various sound sources can be recorded under a plurality of conditions, and characteristic reference signals generated by a reference microphone are included in sound signature database 113. For example, road noise and air turbulence can be recorded at various velocities or simulated velocities, with and without cross-wind, different road surface conditions, etc. When source separation algorithm 111 recognizes one of these sound sources, a source-separated reference signal 173 can be generated to cancel or damp the particular sound source.

Figure 1B:
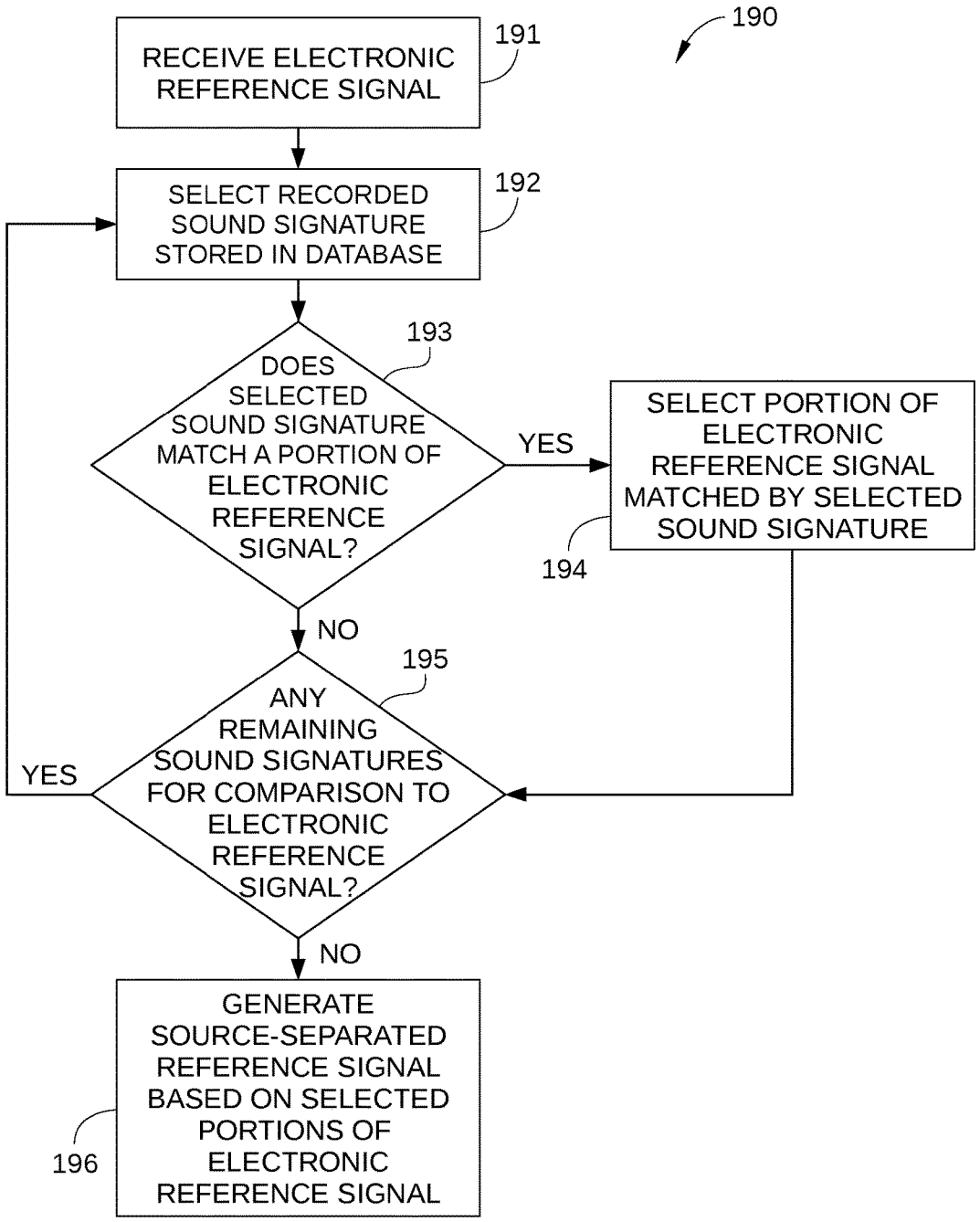
FIG. 1B is a flowchart of method steps for generating a source-separated reference signal, according to various embodiments.

FIG. 1B is a flowchart of method steps for generating a source-separated reference signal, according to various embodiments. Although the method steps are described in conjunction with the systems of FIG. 1, persons skilled in the art will understand that any system configured to perform the method steps, in any order, is within the scope of the various embodiments.

As shown, a method 190 begins at step 191, where source separation algorithm 111 receives electronic reference signal 171 from a reference microphone, for example reference microphone 131. Generally, reference signal 171 is generated based on acoustic inputs from multiple sound sources. For example, as illustrated in FIG. 1, reference microphone 131 receives acoustic input 151 and acoustic input 161, and generates electronic reference signal 171 in response thereto.

In step 192, source separation algorithm 111 selects one of the plurality of recorded sound signature stored in sound signature database 113. Sound signature database may include a variety of sound signatures associated with a particular embodiment of ANC system 100. Generally, sound signature database 113 include groups of representative sound signatures for each potential noise source that ANC system 100 is anticipated to damp. For example, in an embodiment in which ANC system 100 is incorporated in a specific model of motor vehicle, sound signature database 113 may include a group of representative sound signatures of air turbulence generated when the specific model of motor vehicle travels at different velocities, another group of representative sound signatures associated with a specific window being opened as the specific model of motor vehicle travels at different velocities, another group of representative sound signatures associated with tire friction at various velocities and surface conditions, etc.

In step 193, sound signature database 113 determines whether the recorded sound signature matches or substantially matches a portion of electronic reference signal 171. In some embodiments, the portion may be a particular frequency band or bands. Alternatively or additionally, in some embodiments, the portion may be a signal or waveform super-positioned on other signals or waveforms in electronic reference signal 17. If the recorded sound signature matched or substantially matches a portion of electronic reference signal 171, method 190 proceeds to step 194; if not, method 190 proceeds to step 195.

In step 194, source separation algorithm 111 selects the portion of electronic reference signal 171 that is matched by a recorded sound signature in step 193. For example, the frequency band or particular waveform determined to match the recorded sound signature in step 193 may be temporarily stored for use as a component for generating a source-separated reference signal. Method 190 then proceeds to step 195.

In step 195, source separation algorithm 111 determines whether there are any sound signatures remaining in sound signature database 113 to be compared to electronic reference signal 171. If yes, method 190 proceeds back to step 192; if no, method 190 proceeds to step 196.

In step 196, source separation algorithm 111 generates a source-separated reference signal based on the one or more portions of electronic reference signal 171 selected in step 194. Thus, the source-separated reference signal, i.e., source-separated reference signal 173 in FIG. 1, represents acoustic inputs from sound sources recognized by source separation algorithm 111. For a sound source recognized by source separation algorithm 111 to be a noise source, source-separated reference signal 173 may include a phase-shifted compensation signal configured to reduce the power of an acoustic input from the noise sound source in listening location 101. For a sound source recognized by source separation algorithm 111 to be a sound source that is to be enhanced, source-separated reference signal 173 may include a phase-shifted compensation signal configured to increase the power of an acoustic input from the noise sound source in listening location 101.

Controller 120 may be any suitable ANC controller configured to receive source-separated reference signal 173 from source separation processor 110 and an error signal 172 from error microphone 132. In some embodiments, controller 120 shares computational resources with source separation processor 110, such as memory 112. In other embodiments, controller 120 is a separate computing device from source separation processor 110 and is operably coupled to a memory 125. In addition to receiving source-separated reference signal 173, controller 120 is configured to generate an electronic correction signal 174 based thereon to cause acoustic actuator 140 to generate acoustic correction signal 141. Controller 120 may include an adaptive filter 121 that receives source-separated reference signal 173, which represents the noise signal, and provides a compensation signal, i.e., electronic correction signal 174, for reducing or eliminating the noise signal in listening location 101. Controller 120 receives source-separated reference signal 173 from source separation processor 110, and transmits electronic correction signal 174 to acoustic actuator 140. Controller 120 includes adaptive filter 121 because the signal level and the spectral composition of noise to be suppressed, i.e., sound generated by sound source 150 or 160, may vary over time. For example, when ANC system 100 is incorporated in a motor vehicle, adaptive filter 121 may adapt to changes of environmental conditions, such as variations in road surface, wind speed or direction, window position (i.e., open or closed), loading of the engine, etc.

Adaptation algorithm 122 is configured to estimate an unknown system by modifying the filter coefficients of adaptive filter 121 so that the transfer characteristic of adaptive filter 121 approximately matches the transfer characteristic of the unknown system. In ANC applications, adaptive filter 121 may include digital filters, for example finite impulse response (FIR) or infinite impulse response (IIR) filters, whose filter coefficients are modified according to adaptation algorithm 122. In addition, adaptation algorithm 122 adapts the filter coefficients in a recursive process that optimizes the filter characteristic of adaptive filter 121 by reducing or eliminating error signal 172 received from error microphone 132.

Reference microphone 131 and error microphone 132 may be any technically feasible acoustic sensors suitable for use in ANC 100. Reference microphone 131 generates an electronic reference signal 171 in response to sound inputs, such as an acoustic input 151 from sound source 150 and a sound input 161 from sound source 160. Reference microphone 131 may be located proximate sound source 150 or sound source 160, or at a point relatively close to each. For example, in an automobile, reference microphone 131 may be located within a door of the automobile, to facilitate generation of electronic reference signal 171 having high coherence with a particular sound source, such as air turbulence.

Error microphone 132 generates an electronic error signal 172 in response to an acoustic input 152 from sound source 150, sound input 162 from sound source 160, and acoustic correction signal 141 from acoustic actuator 140. Error signal 172 is essentially the difference between the output of the particular sound source to be cancelled (either sound source 150 or 160), and the output of adaptive filter 121, i.e., electronic correction signal 174, which is converted to acoustic correction signal 141 by acoustic actuator 140. Error microphone 132 may be disposed near the area or location targeted for maximum noise reduction, such as listening location 101. For example, in an automobile, error sensor 132 may be disposed within a head rest of a particular passenger or in the ceiling above a particular passenger. Alternatively, in a head phone system, an error microphone 132 may be disposed proximate the hearing cavity of each earcup.

Acoustic actuator 140 is an audio cancelling source of ANC system 100, and may be any technically feasible speaker or other acoustic radiator suitable for use in ANC system 100. In some embodiments, ANC 100 may include multiple acoustic actuators 140, but for clarity only a single acoustic actuator is shown in FIG. 1. Acoustic actuator 140 is generally located a minimum distance from sound sources 150 and 160, so that the propagation time of sound signals from sound sources 150 and 160 to acoustic actuator 140 is greater than the processing time of source separation processor 110 and controller 120.

Acoustic actuator 140 is configured to receive electronic correction signal 174 from controller 120, and radiate acoustic correction signal 141 into listening location 101. Acoustic actuator 140 may be located proximate error microphone 132 and/or the area or location targeted for maximum noise reduction. For example, in an automobile, acoustic actuator 140 may be located in a head rest of a particular seat. In such embodiments, a separate ANC system 100 may be employed for multiple different regions of the vehicle, such as the rear passenger area, the front passenger area, the driver area, etc.

Sound sources 150 and 160 may be any sound sources that generate acoustic signals within the effective operating area of ANC 100. Thus, sound sources 150 and 160 may be unwanted noise, such as road noise or air turbulence, or sounds that are preferably not reduced in volume by ANC 100, such as speech, music, audio content, and the like. For example, in some embodiments, sound source 150 may be a noise source while sound source 160 may be a sound source that is preferably not damped by ANC 100. In such embodiments, reference microphone 131 receives acoustic input 151 from sound source 150 and sound input 161 from sound source 160, and generates electronic reference signal 171. When source separation algorithm 111 recognizes that acoustic input 151 from sound source 150 is a noise signal to be damped, source separation algorithm 111 generates source-separated reference signal 173 to cancel or damp sound source 150. Therefore, source-separated reference signal 173 includes a phase-shifted compensation signal configured to reduce the power of acoustic input 152 from sound source 150 in listening location 101. Alternatively or additionally, in some embodiments, source separation algorithm 111 recognizes that sound input 161 from sound source 160 is an acoustic signal to be enhanced, such as audio content being played in listening location 101, or speech. In such embodiments, source-separated reference signal 173 includes a phase-shifted compensation signal configured to increase the power of acoustic input 162 from sound source 160 in listening location 101.

Figure 2:
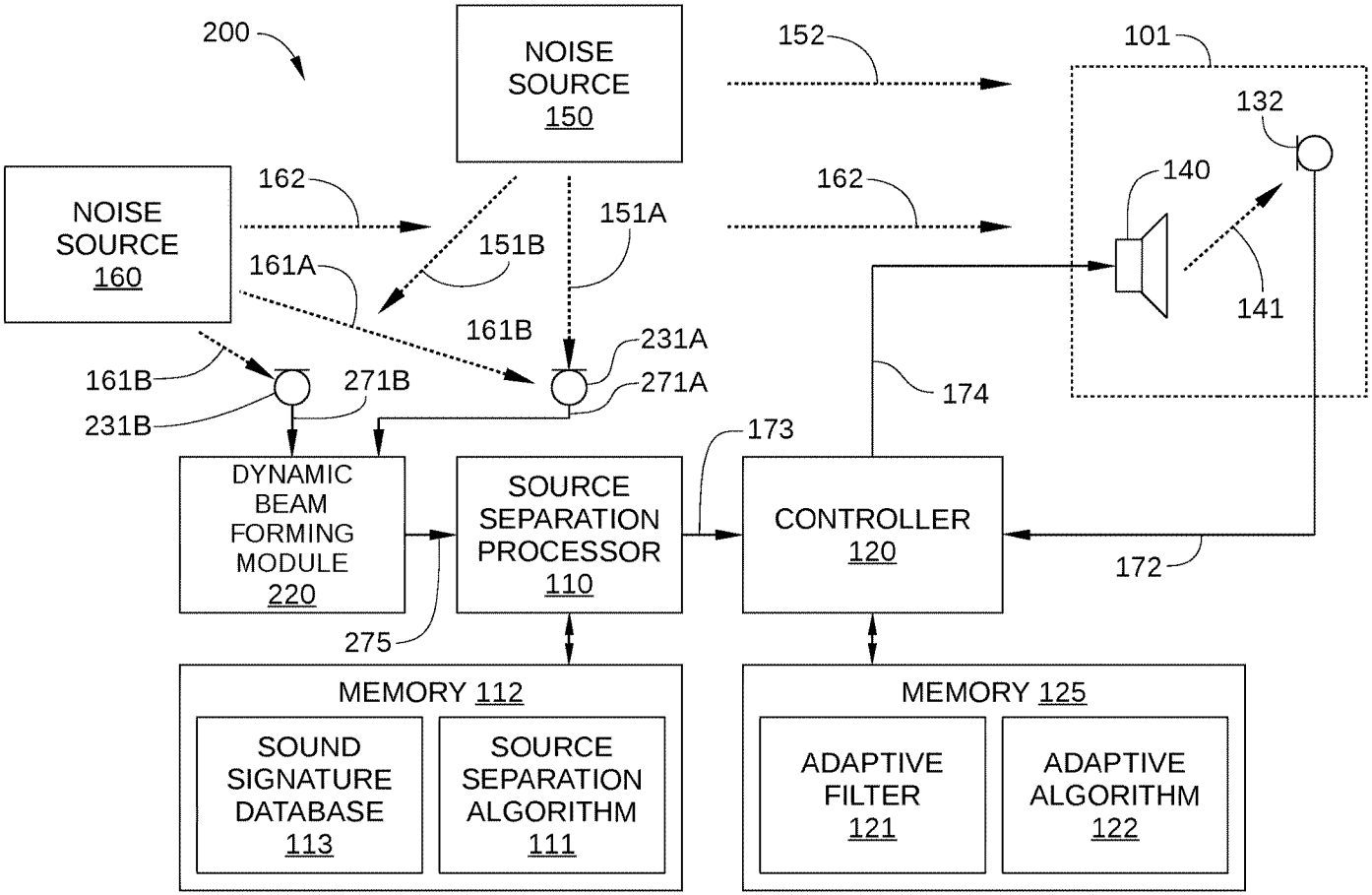
FIG. 2 is a block diagram of an active noise cancellation system, according to various other embodiments.

According to some embodiments, an ANC system may be configured to determine directionality of one or more sound sources, and use such directionality to facilitate generation of a source-separated reference signal. One such example is illustrated in FIG. 2, which is a block diagram of an ANC system 200, according to various other embodiments. ANC system 200 may be substantially similar to ANC 100 in FIG. 1, with the addition of multiple reference microphones 231A and 231B, and a dynamic beam-forming module 220. In the embodiment illustrated in FIG. 2, ANC 200 includes two reference microphones 231A and 231B. In other embodiments, ANC 200 may include three or more reference microphones, each generating an electronic reference signal for use by dynamic beam-forming module 220.

Reference microphones 231A and 231B are disposed separate from each other, so that acoustic input 151A (received from sound source 150 by reference microphone 231A) differs from acoustic input 151B (received from sound source 150 by reference microphone 231B). Similarly, acoustic input 161A (received from sound source 160 by reference microphone 231A) differs from acoustic input 161B (received from sound source 160 by reference microphone 231B). Consequently, electronic reference signal 271A, generated by reference microphone 231A, differs substantially from electronic reference signal 271B, generated by reference microphone 231B. The difference between electronic reference signal 271A and electronic reference signal 271B facilitates the determination, by dynamic beam-forming module 220, of the directionality of sound source 150 and sound source 160 with respect to listening location 101.

Dynamic beam-forming module 220 may share computational resources with source-separating processor 110, or may include a stand-alone computing system, such as a digital signal processor. Dynamic beam-forming module 220 is configured to employ adaptive beam-forming to partially or completely extract the acoustic inputs received from sound source 150 and sound source 160 from all acoustic inputs received by reference microphones 231A and 231B. Generally, dynamic beam-forming module 220 has knowledge of the locations of sound source 150 and sound source 160, so that time-of-arrival calculations can be used to determine which acoustic inputs received by reference microphones 231A and 231B are generated by sound source 150 and which are generated by sound source 160. Dynamic beam-forming module 220 can then generate a directional source-separated signal 275 that can be used to cancel or dampen a particular sound source located in a particular direction, such as sound source 150. For example, in an embodiment in which sound source 150 is considered a noise source, directional source-separated signal 275 can include a phase-shifted compensation signal configured to reduce the power of acoustic input 152 from sound source 150 in listening location 101. Dynamic beam-forming module 220 then transmits directional source-separated signal 275 to source separation processor 110 for further processing by source separation algorithm 111, as described above in conjunction with FIG. 1.

Thus, through the use of dynamic beam-forming module 220 and multiple reference microphones, a portion of an acoustic input received by reference microphones 231A and 231B can be associated with a particular sound source. In such embodiments, the particular sound source is determined based on the distance that the portion of the acoustic input has traveled and the direction from which the portion of the acoustic input has traveled. Consequently, a portion of an acoustic inputs received by reference microphones 231A and 231B can be damped or eliminated in listening location 101 when the portion of the acoustic input is associated with a noise source, e.g., sound source 150.

Figure 3:
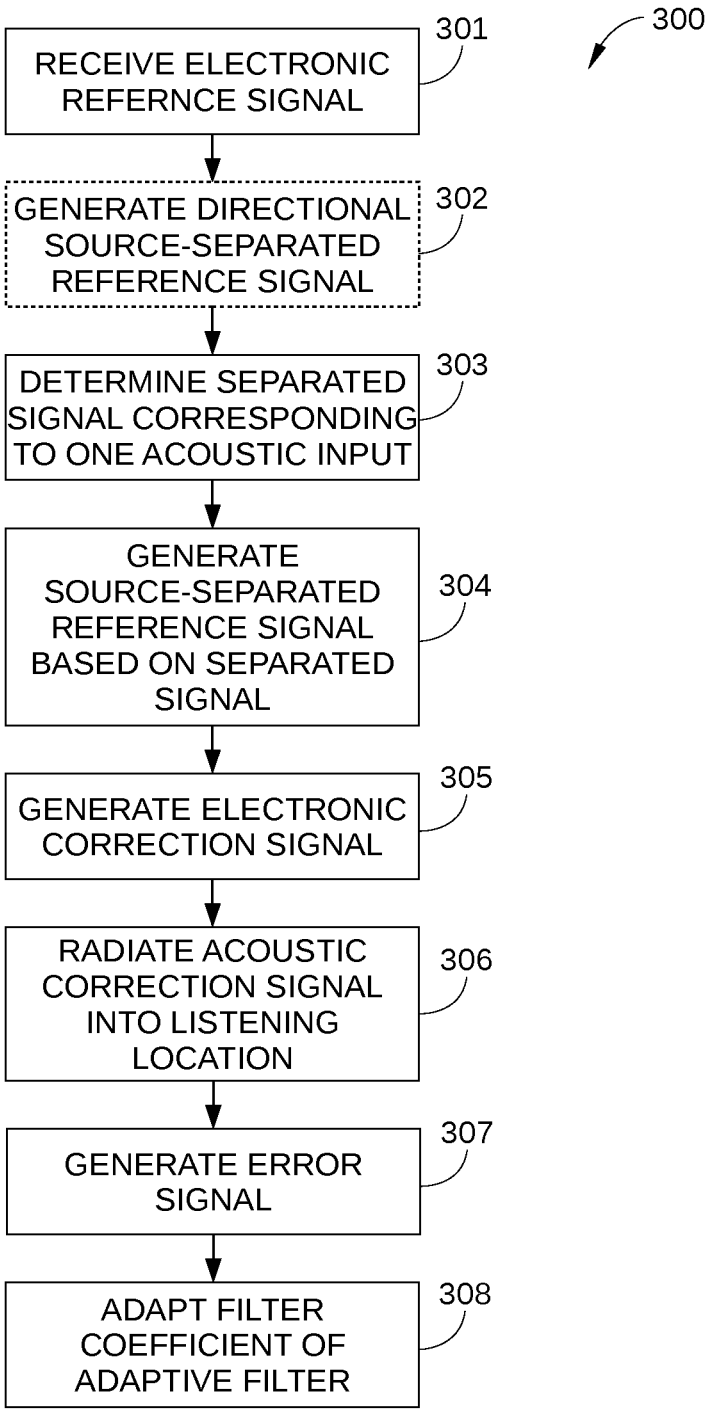
FIG. 3 is a flowchart of method steps for actively cancelling noise, according to various embodiments.

FIG. 3 is a flowchart of method steps for actively cancelling noise, according to various embodiments. Although the method steps are described in conjunction with the systems of FIGS. 1-2, persons skilled in the art will understand that any system configured to perform the method steps, in any order, is within the scope of the various embodiments.

As shown, a method 300 begins at step 301, where the ANC system receives electronic reference signal 171 from a reference microphone, for example reference microphone 131. Alternatively, in embodiments in which an ANC system includes dynamic beam-forming module 220, the ANC system includes multiple reference microphones 231A and 231B, and receives multiple electronic reference signals 271A and 271B, as shown in FIG. 2. It is noted that the reference signal or signals received in step 301 are generated based on acoustic inputs from multiple sound sources. For example, as illustrated in FIG. 1, reference microphone 131 receives acoustic input 151 and acoustic input 161, and generates electronic reference signal 171 in response thereto.

In optional step 302, the ANC system generates directional source-separated reference signal 275, and transmits the directional source-separated reference signal 275 to source separation processor 110. In such embodiments, the ANC system includes dynamic beam-forming module 220, which can associate a portion of the acoustic signals received by reference microphones 231A and 231B with a particular sound source to be damped, for example sound source 150. Dynamic beam-forming module 220 configures directional source-separated reference signal 275 to cancel or damp acoustic inputs determined to originate from a particular sound source located in a particular direction or location. For example, in one embodiment, sound source 150 may correspond to road noise from a lower region of a motor vehicle and the ANC system is configured to dampen such noise. Thus, in such an embodiment, acoustic inputs from the lower region of the motor vehicle may be assumed to be from sound source 150, and source-separated reference signal 275 is configured to cancel or dampen acoustic inputs determined to originate from sound source 150.

In step 303, the ANC system determines a separated signal that corresponds to the acoustic input from one of the multiple sound sources used to generate electronic reference signal 171 received in step 301. For example, in an embodiment in which sound source 150 is a noise source, source separation algorithm 111 identifies acoustic input 151 to be from sound source 150, based on electronic reference signal 171 and on recorded sound signatures in sound signature database 113. In embodiments in which optional step 302 is performed, source separation algorithm 111 identifies acoustic input 151 based on directional source-separated signal 275 rather than on electronic reference signal 171.

In step 304, source separation algorithm 111 of the ANC system generates source-separated reference signal 173 based on the separated signal determined in step 303. Thus, source-separated reference signal 173 is configured to cancel or dampen the power of acoustic input 152 from sound source 150 in listening location 101, but not the power of acoustic input 162 from sound source 160 in listening location 101. Alternatively or additionally, in embodiments in which a sound source, e.g., sound source 160, is preferably enhanced, source-separated reference signal 173 may be configured to increase the power of acoustic input 162 in listening location 101.

In step 305, adaptation filter 121 of controller 120 receives source-separated reference signal 173 and generates electronic correction signal 174 based on source-separated reference signal 173. Because source-separated reference signal 173 is based on a particular sound source identified by source separation algorithm 111, there can be a high coherence between acoustic inputs from that particular sound source and source-separated reference signal 173. Consequently, effective noise reduction of the sound source is possible.

In step 306, acoustic actuator 140 receives electronic correction signal 174 generated by adaptation filter 121, and radiates acoustic correction signal 141 into listening location 101. Because source-separated reference signal 173 is configured only to cancel or dampen the power of acoustic input 152 from sound source 150 in listening location 101, the power of acoustic input 162 in listening location 101 is largely unaffected by acoustic correction signal 141. Therefore, the sound-cancelling acoustic correction signal 141 radiated into listening location 101 by acoustic actuator 140 only substantially cancels or damps acoustic inputs from sound source 150. Alternatively, in embodiments in which sound source 160 is a sound source that is to be enhanced, radiation of acoustic correction signal 141 into listening location 101 can result in an increase in the power of acoustic input 162 in listening location 101.

In step 307, error microphone 132 receives acoustic input 152, acoustic input 162, and acoustic correction signal 141, and generates error signal 172 in response thereto.

In step 308, adaptive algorithm 122 in controller 120 receives error signal 172, and, in response thereto, adapts the filter coefficients of adaptive filter 121 to minimize error signal 172.

In sum, various embodiments set forth systems and techniques for active noise cancellation. A source separation algorithm enables the identification of acoustic inputs from a particular sound source based on a reference signal generated with one or more microphones. Consequently, the identified acoustic inputs can be cancelled or damped in a targeted listening location via an acoustic correction signal, where the acoustic correction signal is generated based on a sound source separated from the reference signal. Advantageously, the reference signal can be generated with a microphone, even though such a reference signal may include a combination of multiple acoustic inputs. Thus, noise sources that cannot be individually measured, for example with an accelerometer mounted on a vibrating structure, can still be identified and actively cancelled.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors or gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

The claimed invention is:

1. A method for actively cancelling noise, the method comprising:

receiving an electronic reference signal from one or more microphones that receives a first acoustic input from a first sound source and a second acoustic input from a second sound source;

based on the electronic reference signal and on a database of recorded sound signatures, selecting a portion of the first acoustic input as a separated signal;

modifying the separated signal based on at least one of the recorded sound signatures to generate a source-separated reference signal; and generating an electronic correction signal based on the source-separated reference signal.

2. The method of claim 1, further comprising:

receiving an error signal from a microphone disposed in a listening location; and based on the error signal, modifying coefficients of an adaptive filter that generates the electronic correction signal.

3. The method of claim 2, wherein the database is stored in a first memory and the adaptive filter is stored in a second memory.

4. The method of claim 3, wherein the first memory is locally coupled to the one or more microphones.

5. The method of claim 1, further comprising radiating an acoustic correction signal based on the electronic correction signal towards a listening location.

6. The method of claim 5, wherein the electronic correction signal reduces a third acoustic input from the first sound source in the listening location.

7. The method of claim 5, wherein the electronic correction signal comprises a phase-shifted compensation signal.

8. The method of claim 1, further comprising radiating an acoustic correction signal based on the electronic correction signal into the listening location.

9. The method of claim 1, wherein the electronic correction signal comprises a phase-shifted compensation signal that reduces a third acoustic input from the first sound source in the listening location.

10. The method of claim 1, wherein the electronic correction signal comprises a phase-shifted compensation signal that increases a third acoustic input from the first sound source in the listening location.

11. The method of claim 10, wherein the first sound source comprises at least one of speech or audio content.

12. The method of claim 10, wherein the electronic correction signal comprises a phase-shifted compensation signal that reduces a fourth acoustic input from the second sound source in the listening location.

13. The method of claim 10, wherein the second sound source comprises an acoustic noise source.

14. The method of claim 13, wherein the acoustic noise source comprises a spatially uncorrelated noise source.

15. An active noise cancellation system, comprising:

a first microphone that generates an electronic reference signal in response to a first acoustic input from a first sound source and a second acoustic input from a second sound source;

at least one memory that stores a source separation algorithm;

at least one processor that is coupled to the at least one memory and, when executing the source separation algorithm, is configured to:

receive the electronic reference signal, based on the electronic reference signal and on a database of recorded sound signatures stored in the at least one memory, selecting a portion of the first acoustic input as a separated signal, modify the separated signal based on at least one of the recorded sound signatures to generate a source-separated reference signal, and generate an electronic correction signal; and a second microphone that generates an error signal in response to acoustic inputs.

16. The active noise cancellation system of claim 15, wherein the second microphone generates the error signal in response to a third acoustic input from the first sound source, a fourth acoustic input from the second sound source, and an acoustic correction signal generated by an acoustic actuator coupled to an adaptive filter.

17. The active noise cancellation system of claim 15, further comprising:

a third microphone that generates an additional electronic reference signal in response to a third acoustic input from the first sound source and a fourth acoustic input from the second sound source; and a dynamic beam-forming module configured to receive the electronic reference signal from the first microphone and the additional electronic reference signal from the third microphone, generate a directional source-separated reference signal, and transmit the directional source-separated reference signal to the processor.

18. The active noise cancellation system of claim 15, wherein the electronic correction signal comprises a phase-shifted compensation signal that reduces a third acoustic input from the first sound source in the listening location.

19. A non-transitory computer readable medium storing instructions that, when executed by a processor, cause the processor to perform the steps of:

receiving an electronic reference signal from one or more microphones that receives a first acoustic input from a first sound source and a second acoustic input from a second sound source;

based on the electronic reference signal and on a database of recorded sound signatures, selecting a portion of the first acoustic input as a separated signal;

modifying the separated signal based on at least one of the recorded sound signatures to generate a source-separated reference signal; and generating an electronic correction signal based on the source-separated reference signal.

20. The non-transitory computer readable medium of claim 19, further comprising radiating an acoustic correction signal based on the electronic correction signal towards a listening location.

21. The non-transitory computer readable medium of claim 20, wherein the electronic correction signal reduces a third acoustic input from the first sound source in the listening location.

22. The non-transitory computer readable medium of claim 20, wherein the electronic correction signal comprises a phase-shifted compensation signal.

* * * * *